US011542138B2

(12) United States Patent
Franceschini

(10) Patent No.: US 11,542,138 B2
(45) Date of Patent: Jan. 3, 2023

(54) FILLING UNIT FOR FILLING CONTAINERS OF TWO DIFFERENT TYPES WITH A LIQUID SUBSTANCE, IN PARTICULAR WITH A BEVERAGE

(71) Applicant: KOSME S.R.L. UNIPERSONALE, Mantova (IT)

(72) Inventor: Gianluca Franceschini, Marmirolo (IT)

(73) Assignee: KOSME S.R.L. UNIPERSONALE, Roverbella (IT)

( * ) Notice: Subject to any disclaimer, the term of this patent is extended or adjusted under 35 U.S.C. 154(b) by 0 days.

(21) Appl. No.: 17/332,190

(22) Filed: May 27, 2021

(65) Prior Publication Data

US 2021/0380386 A1 Dec. 9, 2021

(30) Foreign Application Priority Data

Jun. 5, 2020 (IT) ..... 102020000013450

(51) Int. Cl.
*B67C 3/26* (2006.01)
*B67C 3/22* (2006.01)
*B67C 3/28* (2006.01)

(52) U.S. Cl.
CPC ..... *B67C 3/26* (2013.01); *B67C 3/225* (2013.01); *B67C 3/282* (2013.01); *B67C 2003/2657* (2013.01)

(58) Field of Classification Search
CPC .. B67C 3/26; B67C 3/20; B67C 3/225; B67C 3/281; B67C 3/282; B67C 2003/2657; B67C 2003/2668; B67C 2003/2671; B67C 2003/2674; B67C 2003/2677
See application file for complete search history.

(56) References Cited

U.S. PATENT DOCUMENTS 2,645,401 A * 7/1953 Kerr ..... B67C 3/2637 141/117
4,674,547 A * 6/1987 Simonazzi ..... G11B 7/126 141/250

(Continued)

FOREIGN PATENT DOCUMENTS

EP 0336063 A2 10/1989
EP 0336063 A3 3/1990

(Continued)

*Primary Examiner* — Nicolas A Arnett
(74) *Attorney, Agent, or Firm* — Pearne & Gordon LLP

(57) ABSTRACT

A filling unit (1) comprises: a plate (12) for resting a container to be filled; a housing (2) facing the plate (12) to receive container's mouth; a dispenser (3) which opens onto the housing (2) to dispense liquid substance towards the container. The plate (12) is movable towards or, vice versa, away from the dispenser (3). The housing (2) comprises a bottom wall (24), fitted with a first annular gasket (21), and an annular body (6), movable relative to the bottom wall (24) and fitted with a second annular gasket (22). With a container (90) of a first type positioned on the plate (12), the plate (12) is moved towards the dispenser (3) to bring container's mouth (91) into contact with the first annular gasket (21). With a container (95) of a second type positioned on the plate (12), the annular body (6) is moved towards the plate (12) to bring the second annular gasket (22) into contact with container's mouth (96).

13 Claims, 12 Drawing Sheets

(56) References Cited

U.S. PATENT DOCUMENTS

| | | | | |
|---|---|---|---|---|
| 5,125,441 | A * | 6/1992 | Mette | B67C 3/26 141/59 |
| 7,287,562 | B2 * | 10/2007 | Tanikawa | B67C 3/2614 141/367 |
| 8,726,946 | B2 * | 5/2014 | Clusserath | B67C 3/10 141/59 |
| 10,005,653 | B2 * | 6/2018 | Clüsserath | B67C 3/06 |
| 10,214,406 | B2 * | 2/2019 | DiCarlo | B67C 3/286 |
| 10,968,091 | B2 * | 4/2021 | Krulitsch | B65B 31/044 |
| 11,008,204 | B2 * | 5/2021 | Nishino | B67D 1/0081 |
| 2005/0172580 | A1 * | 8/2005 | Krulitsch | B67C 3/004 53/471 |
| 2005/0178466 | A1 * | 8/2005 | Tanikawa | B67C 3/2614 141/57 |
| 2010/0071802 | A1 * | 3/2010 | Clusserath | B65B 39/001 141/46 |
| 2013/0240081 | A1 * | 9/2013 | Balzarin | B67C 3/2634 141/7 |
| 2016/0332859 | A1 * | 11/2016 | Clüsserath | B65G 47/846 |
| 2017/0001848 | A1 * | 1/2017 | DiCarlo | B67C 3/16 |
| 2017/0096320 | A1 * | 4/2017 | Zoni | B65C 9/40 |
| 2017/0158482 | A1 * | 6/2017 | Bondi | B67C 3/24 |
| 2019/0144251 | A1 * | 5/2019 | DiCarlo | B67C 3/16 141/234 |
| 2019/0152754 | A1 * | 5/2019 | Nishino | B67C 3/281 |
| 2021/0380385 | A1 * | 12/2021 | Franceschini | B67C 3/007 |
| 2021/0380386 | A1 * | 12/2021 | Franceschini | B67C 3/2617 |
| 2021/0380387 | A1 * | 12/2021 | Franceschini | B67C 3/225 |

FOREIGN PATENT DOCUMENTS

| | | | |
|---|---|---|---|
| EP | 1564180 | A1 | 8/2005 |
| EP | 2930140 | A1 | 10/2015 |
| JP | 2002370797 | A | 12/2002 |
| WO | 2018100004 | A1 | 6/2018 |

* cited by examiner

FILLING UNIT FOR FILLING CONTAINERS OF TWO DIFFERENT TYPES WITH A LIQUID SUBSTANCE, IN PARTICULAR WITH A BEVERAGE

This invention relates in general to the sector of apparatuses for filling containers, in particular for filling bottles and cans with a liquid substance such as a beverage.

Specifically, this invention relates to a filling unit which can be used for filling two different types of containers, which in particular are bottles and cans, with the liquid substance, which in particular is a beverage.

Modern apparatuses for filling containers are usually automated machines which operate with high production capacities, which are measured in terms of thousands (or even tens of thousands) of containers per hour. In order to be able to operate without hitches at such high speeds, the machine has to be perfectly configured and adjusted for the specific model of container to be filled, in terms of shape, dimensions and mechanical properties of the specific container.

In the sector it is well known that performing a "format change-over", that is to say, adapting and adjusting the filling machine so that it can process a different model of container, is usually quite laborious, involving the substitution of machine components (for example, gaskets for making a seal with the container, sensors, parts of devices for moving the containers, control systems) and requiring some machine downtime. This disadvantage may be even more serious for machines which, in order to offer higher productivity, are equipped with a large number of filling units. Indeed, each filling unit must be reconfigured and calibrated for the container model, therefore the time and manpower needed are in proportion to the number of filling units.

Moreover, filling machines are generally divided into two categories: machines for filling bottles and machines for filling cans. Given the great technical diversity between these two types of containers, it is not usually possible (or in any case it is quite laborious) to reconfigure a machine initially designed for filling bottles so that it can be used for filling cans, and vice versa.

The disadvantages mentioned greatly limit the flexibility of use of a filling machine in a production line and are particularly disadvantageous for a production line which, based on market demand, must frequently switch from one format to another.

For example, some manufacturers of beverages (such as carbonated beverages and beer) sell the same product both in bottles and cans. The need for a filling line dedicated to bottles and a filling line dedicated to cans, or alternatively the need for long machine downtimes for a change-over of the type of container, may be serious disadvantages and involve significant costs for beverage manufacturers.

These disadvantages have already been partly dealt with in the sector. In particular machines have been proposed whose filling units can be used for cans or bottles, subject to a reduced number of operations to be carried out. For some of those machines, the filling units are already set up with a first gasket, for making a seal with the mouth of a bottle, and with a second gasket, for making a seal with the mouth of a can. However, such machines are often trade-off solutions which are not completely effective and which cannot fully take into account the distinctive features of and differences between the filling of bottles and the filling of cans.

Therefore, in the prior art there is room for solutions providing improvements which make the filling of bottles and cans using a same machine easier and more effective.

In this context the technical purpose which forms the basis of this invention is to provide a machine for filling containers which allows to overcome the above-mentioned disadvantages of the prior art or which at least offers an alternative solution to the known ones.

The technical purpose and the aims indicated are substantially achieved by a filling unit for filling containers with a liquid substance, made in accordance with claim 1. Particular embodiments of this invention are defined in the corresponding dependent claims.

This invention also relates to a machine for filling containers with a liquid substance, comprising a plurality of said filling units.

The filling unit described below and illustrated in the figures comprises a plurality of aspects which may be the subject of patent protection independently of each other. A first aspect relates to control of the degree of filling of the container and the consequent management of the dispensing of liquid substance in the container; a second aspect relates to the movement of the parts of the filling unit for positioning the container in the position required for filling; a third aspect relates to the creation of a particular flow of liquid substance in the container during the filling.

The claims attached to this patent application relate to one of those aspects. Obviously that does not constitute giving up the right to protect the other aspects and the Applicant reserves the right to protect the other aspects in independent applications or in divisional applications, or to amend the claims of this patent application by including in them features relating to one or more of the other aspects.

The invention which is the subject of this patent application specifically relates to a filling unit which comprises a filling head and a resting plate for the container which, in order to position the container in the position required for filling, are moved in a different way depending on the type of container to be filled.

For containers of a first type (in particular bottles), the resting plate receives the container and is moved towards the filling head, making the mouth of the container enter a housing and bringing it into contact with a respective seal gasket. Basically, the movement of the plate moves the container relative to the filling head and positions the container in the filling position.

For containers of a second type (in particular cans), the resting plate receives the container; a movable component of the filling head is moved towards the mouth of the container, in order to put the latter in contact with the respective gasket mounted on the movable component. Basically, the container filling position is reached by moving the gasket towards the container, while the plate remains stationary.

That is useful because, given the different features of the types of containers (in terms of dimensions, material, weight and strength), it allows those differences to be taken into account by using the positioning method which is the most suitable, most efficient and has the least risks of damaging the container.

Further features and the advantages of this invention will be more apparent from the detailed description of an embodiment of a filling unit for filling containers with a liquid substance, presented by way of example and non-limiting.

Reference will be made to the figures of the accompanying drawings, in which.

With reference to the accompanying figures, a filling unit according to this invention is indicated with the reference number 1. The filling unit 1 is designed to be used for filling containers with a liquid substance 99, which in particular is a beverage and more particularly is a carbonated beverage.

Figure 26:
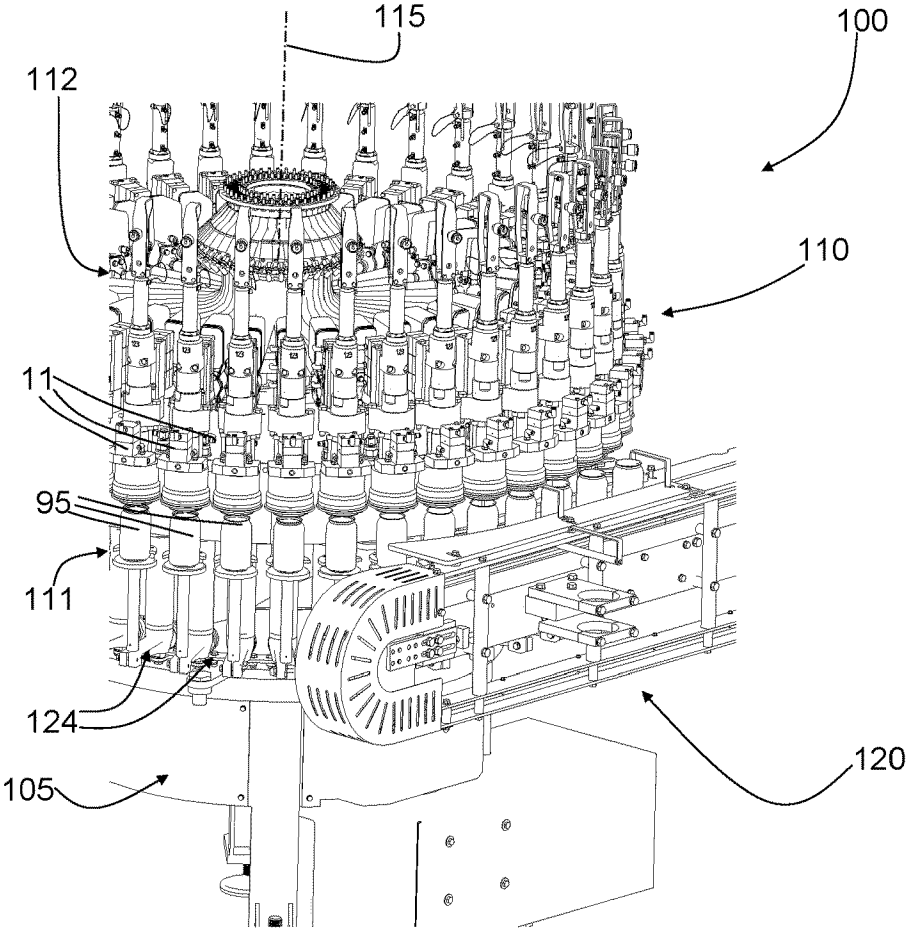
FIG. 26 shows the detail of the machine of FIG. 25, during the filling of containers of the second type.
Figure 25:
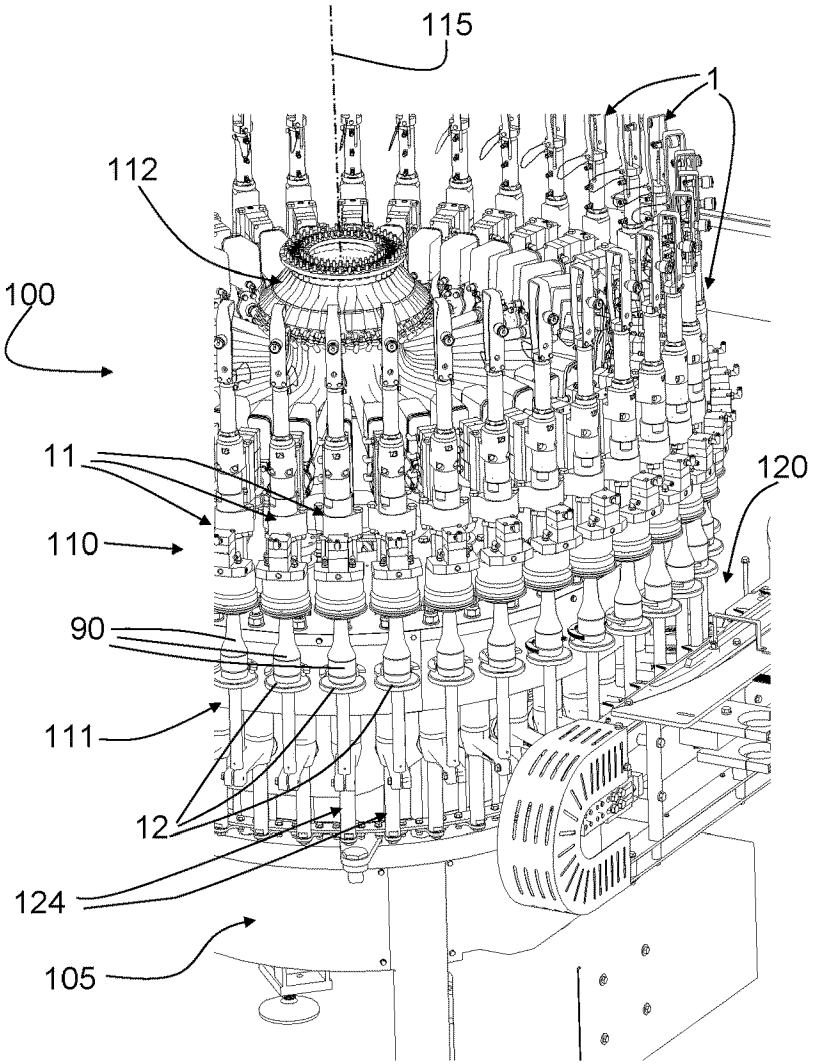
FIG. 25 shows a detail of a machine comprising a plurality of filling units of FIG. 1, during the filling of containers of the first type.

The filling unit 1 is part of a machine 100 for filling the containers with the liquid substance 99. As shown in FIGS. 25 and 26, the machine 100 comprises a plurality of filling units 1.

As will become clearer below, the filling unit 1 can be used, and is configured, to fill containers of a first types and to fill containers of a second type. For example, the two types of containers differ in terms of the dimensions of the mouth of the container, the dimensions of the container, and/or the material used to make the container. Specifically, the containers of the first type are bottles 90 (for example made of glass or plastic, PET or HDPE), the containers of the second type are cans 95 (made of metal, for example aluminium).

The filling unit 1 comprises a main body 11 and a feed duct 13 for feeding the liquid substance 99 to the main body 11. On the feed duct 13 there is a valve 14 for adjusting the flow speed of the liquid substance, which allows operation in a "fast-filling" mode or in a "slow-filling" mode (which gives greater precision for the level of liquid substance in the container).

The main body 11 comprises a housing 2 configured to receive a mouth of the container to be filled. The housing 2 comprises a bottom wall 24 and a lateral wall 25, which delimit a cavity 26. Basically, the housing 2 is bell-shaped.

The housing 2 is fitted with a first annular gasket 21, which is designed to come into contact with a mouth 91 of a container 90 of the first type, and a second annular gasket 22, which is designed to come into contact with a mouth 96 of a container 95 of the second type. Basically, the annular gasket 21, 22 makes contact with an edge of the mouth of the respective container and makes a seal with it. Thanks to the presence of the two annular gaskets 21, 22, as well as the shape and dimensions of the cavity 26 formed by the housing 2, the latter is configured to receive the mouth 91 of a container 90 of the first type and, alternatively, the mouth 96 of a container 95 of the second type.

The first annular gasket 21 is smaller in size than the second annular gasket 22 (in particular, since the gaskets are circular, the first annular gasket 21 has a smaller diameter than the second annular gasket 22) and is positioned at a shorter distance from bottom wall 24 of the housing 2. Specifically, the first annular gasket 21 is positioned on the bottom wall 24 (it even forms part of the bottom wall 24). The second annular gasket 22 is further away from the bottom wall 24 than the first annular gasket 21 and is positioned on the lateral wall 25 of the housing 2.

The lateral wall 25 has at least one first section 251 which has a divergent shape from the bottom wall 24, basically it diverges from the first annular gasket 21 towards the second annular gasket 22. That first section 251, which has a cylindrical symmetry relative to a central axis, in particular has a truncated cone shape.

The main body 11 also comprises a dispenser 3 having a dispensing duct 31 which ends in a dispensing opening 30. The dispenser 3 opens onto the housing 2: the dispensing opening 30 opens on the bottom wall 24 of the housing. In particular, the first annular gasket 21 encircles the dispensing opening 30. In use, the dispenser 3 faces towards the mouth 91, 96 of the container 90, 95 so as to dispense, through the dispensing opening 30, the liquid substance 99 towards an internal volume 92, 97 of the container 90, 95. The main body 11 comprises a valve 4, which is interposed between the feed duct 13 and the dispensing opening 30. The valve 4 is controllable to assume an open position and a closed position: in the open position, the valve 4 allows the passage of the liquid substance and its dispensing from the dispenser 3; in the closed position, the valve 4 closes the passage and prevents the dispensing of the liquid substance.

The valve 4 comprises a valve body 41 (which specifically is a portion of the main body 11) and, inside the valve body 41, a seal seat 42, a valve member 43 and a stem 44. The stem 44 is movable in the valve body 41 and the valve member 43 is fixed to the stem 44. Therefore, the valve member 43 is movable by the stem 44 between a position of contact with the seal seat 42, wherein the valve 4 is closed, and a position apart from the seal seat 42, wherein the valve 4 is open.

Specifically: the seal seat 42 is an annular region on an inner wall of a duct 45 in the valve body 41 and is located at a narrowing of the duct 45; the valve member 43 is a body which is located in the duct 45, is moved along the duct by the stem 44 and is fitted with an annular gasket 431 designed to come into contact with the seal seat 42. The duct 45 of the valve 4 receives the liquid substance 99 from the feed duct 13.

The valve 4 is controlled by a control system. For example a pneumatic actuator 46 (whose air inlet is indicated with the reference number 460) moves the stem 44 and the valve member 43 towards the closed position; the valve 4 further comprises springs which bring the stem 44 and the valve member 43 back towards the open position. Specifically, the pneumatic actuator 46 is controlled by a solenoid valve (ie, an electromagnetic valve) remotely located in a pneumatic panel of the control system of the machine 100. The solenoid valve and the pneumatic panel are not shown in the figures, but they can be made in a known way. The aspects of operation of the valve 4 themselves are similar to the prior art and therefore do not require further description.

In the embodiment shown in the figures, the dispenser 3 is at one end of the valve body 41 and the stem 44 has an axial extension that is substantially coaxial with the dispensing opening 30 of the dispenser 3. Basically, the stem 44 is an elongated body which extends along a longitudinal axis 40. The longitudinal axis 40 is also the axis of the duct 45 of the valve 4, in which the stem 44 is axially movable between the closed position and the open position, and vice versa. The dispensing duct 31 is coaxial (or even partly coincides) with the duct 45 of the valve 4

Figure 11:
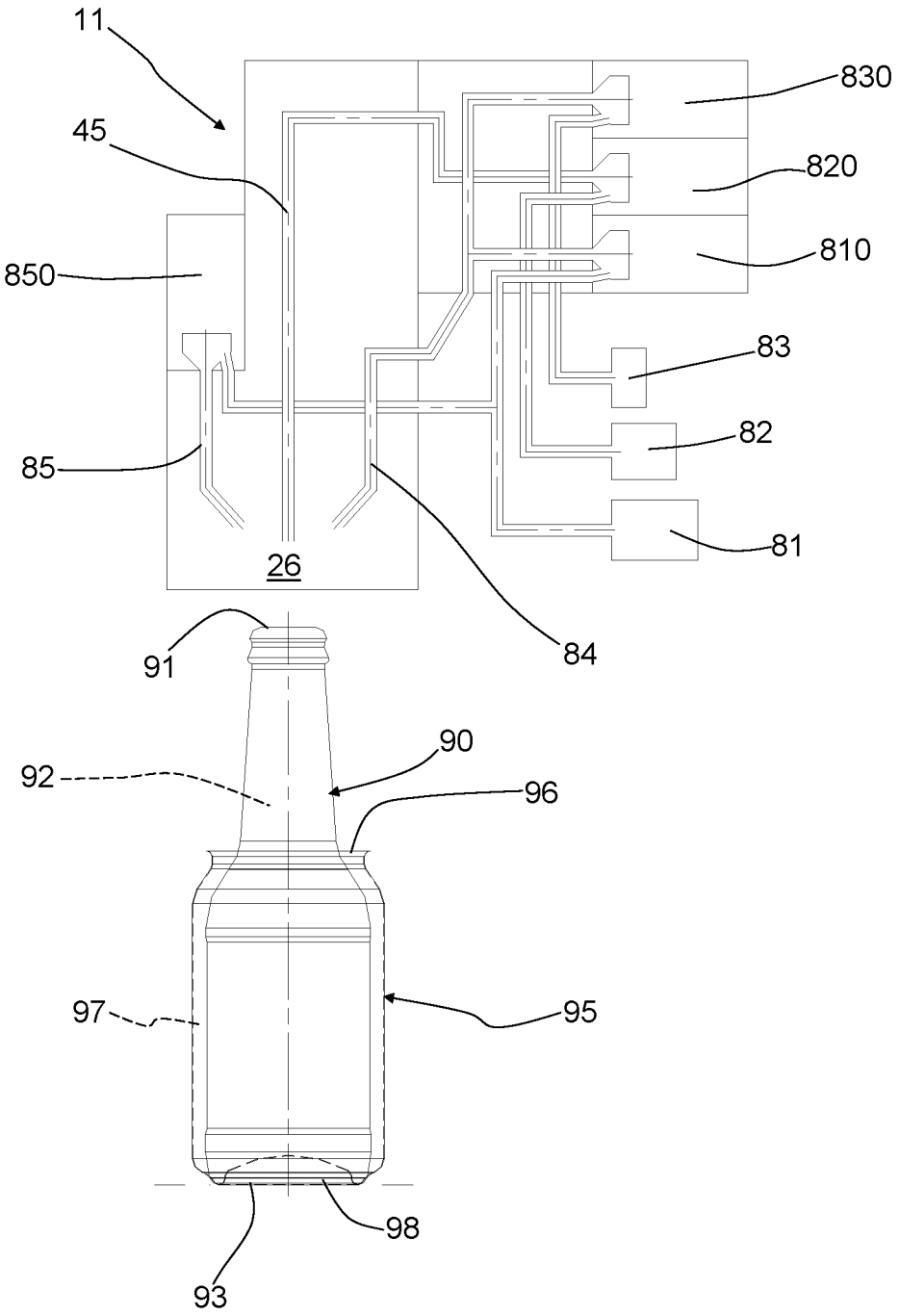
FIG. 11 shows a diagram of the circuits of the filling unit of FIG. 1.
Figure 12:
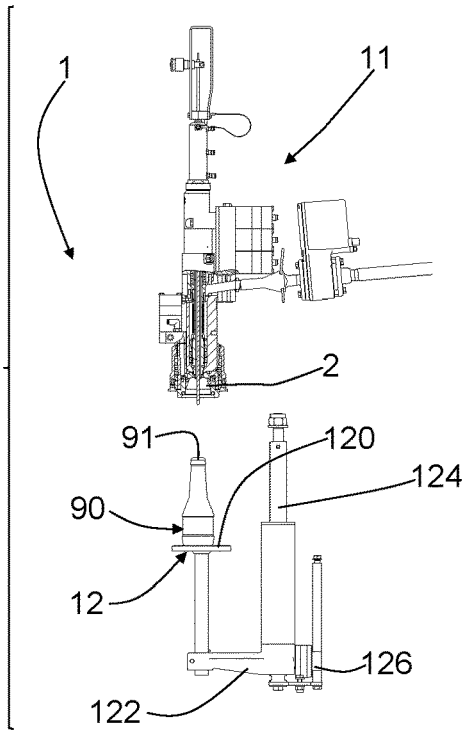
FIGS. 12 and 13 are cross-sectional side views of an initial positioning step and a final filling step for a container of the first type in the filling unit of FIG. 1.

The main body 11 also comprises further circuits, schematically illustrated in FIG. 11, for cleaning in place, for flushing with carbon dioxide, for pressurisation and for creating a vacuum in the container.

In particular there are a vacuum line 81, a carbon dioxide line 82 and a "snifting" line 83, which are connected respectively to a vacuum valve 810, to a carbon dioxide valve 820 and to a snifting valve 830. The valves 810, 820, 830 are pneumatically operated and have respective air inlets 811, 821, 831 which are connected to respective solenoid valves remotely located in the pneumatic panel.

The valve for carbon dioxide 820 is also connected to the duct 45 of the valve 4. The vacuum valve 810 and the snifting valve 830 are connected to a duct 84 which communicates with the cavity 26 of the housing 2. The vacuum line 81 is also connected to a flushing valve 850, also operated by a pneumatic piston (whose air inlet 851 is connected to a solenoid valve remotely located in the pneumatic panel), which communicates with the cavity 26 of the housing 2 by means of a respective duct 85. The flushing valve 850 can be used in particular for performing flushing of cans 95.

The term "snifting" means a venting or a degas action to bring the pressure in the head space of the container to the atmospheric pressure at the end of the filling.

Basically, the main body 11 is a filling head.

The filling unit 1 also comprises a plate 12, which forms a resting surface 120 for a bottom 93, 98 of the container 90, 95 to be filled. The housing 2 faces towards the plate 12 and the cavity 26 formed by the housing 2 opens towards the plate 12. Basically, the plate 12 is positioned under the filling head 11 and the cavity 26 opens downwards, towards where the plate 12 is located. During the filling, the container 90, 95 is locked between the plate 12 and the corresponding annular gasket 21, 22 of the housing 2.

The plate 12 is movable towards or, vice versa, away from the filling head 11 and in particular relative to the dispenser 3 and to the bottom wall 24 of the housing 2. That movement varies the distance between the resting surface 120 and the bottom wall 24 of the housing 2. For this purpose, the plate 12 is mounted on a support 122 which is slidably mounted on a fixed structure 124. A first actuator 126 is positioned for moving the support 122 and therefore the plate 12. Specifically, the line of movement of the plate 12 is vertical.

A first innovative aspect of the filling unit 1 described here relates to the control of the degree of filling of the container and the consequent management of the dispensing of liquid substance in the container, that is to say, the control of the valve 4. The filling unit 1 comprises a level sensor 51 for detecting a filled level of the liquid substance 99 in the internal volume of the container; the filling unit 1 further comprises a volume meter 52, for measuring a volume of the liquid substance 99 fed to the dispenser 3.

The control system which controls the valve 4 is operationally connected to the level sensor 51 and to the volume meter 52. It is configured to control the valve 4 based on the filled level detected by the level sensor 51, when the filling unit 1 is used for filling a container 90 of the first type, and is configured to control the valve 4 based on the fed volume that is measured by the volume meter 52, when the filling unit 1 is used for filling a container 95 of the second type.

In the specific example, the level sensor 51 is used for the bottles and the volume meter 52 is used for the cans. For the bottles, the valve 4 is closed when a predetermined level of liquid substance is reached in the bottle. For the cans, the valve 4 is closed when a predetermined volume of dispensed liquid substance is reached.

Basically, the filling unit 1 is already equipped with two different measuring devices. Depending on the container to be filled, it is possible to use the one best suited to the specific type of container, without any need to substitute the measuring device or to accept working with a device less suited to the type of container.

For example, the level sensor may be preferable for containers with a narrow neck, compared with containers with a wide neck, since towards the end of the filling a same quantity of liquid substance added causes a greater level variation. In this case (for example for bottles) the level measurement may be more sensitive than the volume measurement and therefore is preferable. Conversely, the volume measurement may be better suited to cans or cylindrical containers. Moreover, for transparent containers in which it is possible to see the contents (such a glass or plastic bottles) it may be preferable to use the level sensor, so that all of the containers filled are presented to the consumer with the same level of contents.

In particular the volume meter 52 is a flow meter which is positioned on the feed duct 13. Specifically, it is a flow meter of an inductive type. The volume meter 52 is connected to the control system for transmitting the measurement taken.

The level sensor 51, in the embodiment illustrated, comprises a probe 54 designed to be inserted into the internal volume 92 of the container 90, so as to come into contact with the liquid substance 99 in the container 90 itself. For this purpose, the probe 54 protrudes from the dispenser 3 and extends into the housing 2 designed to receive the mouth 91 of the container 90. Therefore, the probe 54 is inserted through the mouth 91 when the container 90 is positioned. If necessary, the length of the protruding section may be adjusted and is selected based on the predetermined level for the liquid substance in the container 90.

Figure 7:
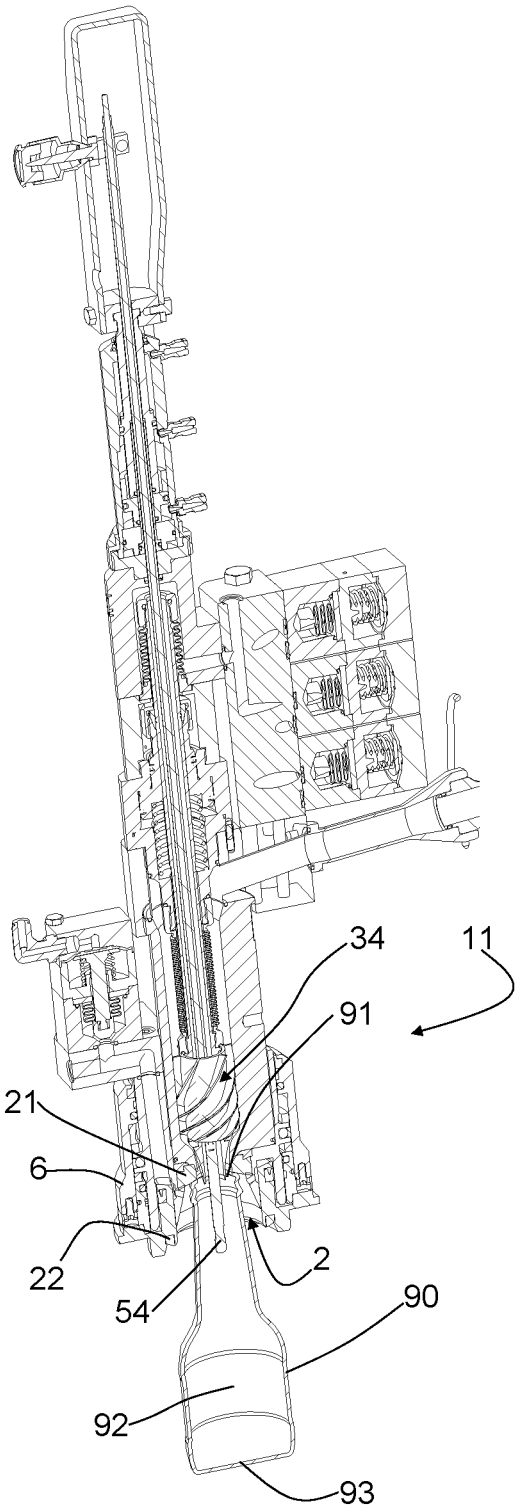
FIGS. 7 and 8 are cross-sectional views, respectively a perspective view and a side view, of a detail of the filling unit of FIG. 1 during the filling of a container of a first type, which is a bottle.
Figure 8:
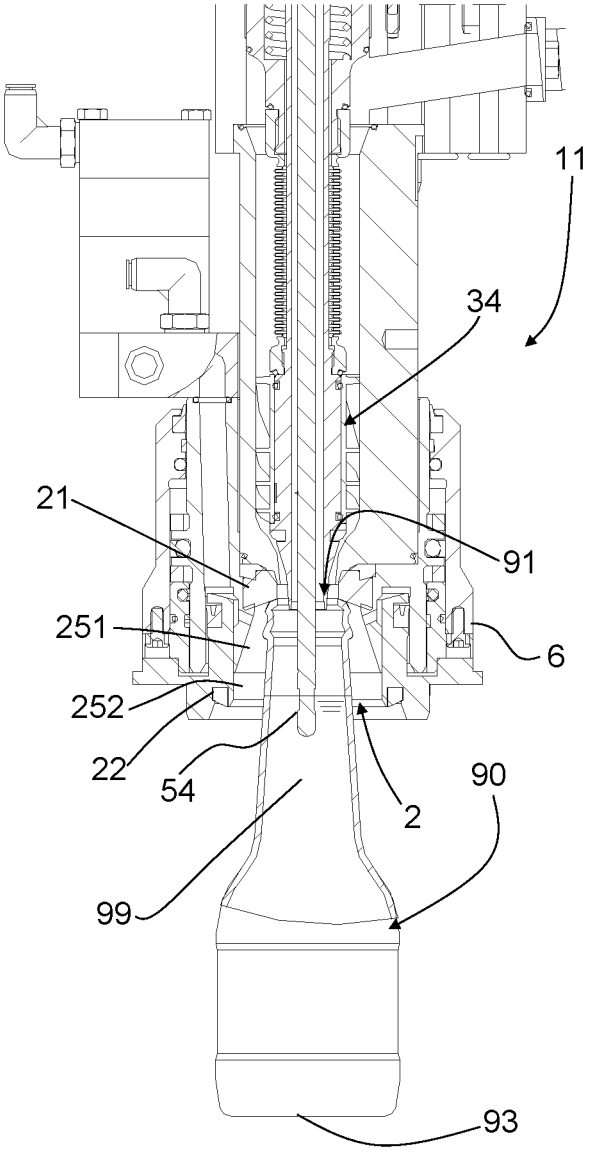
Figure 9:
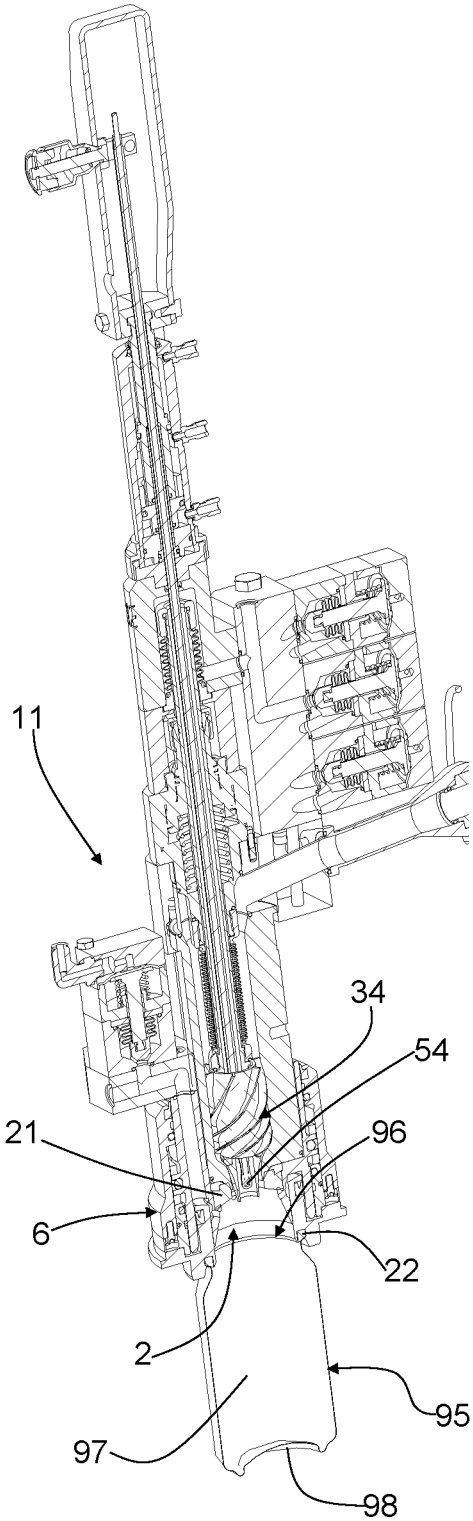
FIGS. 9 and 10 are cross-sectional views, respectively a perspective view and a side view, of a detail of the filling unit of FIG. 1 during the filling of a container of a second type, which is a can.
Figure 10:
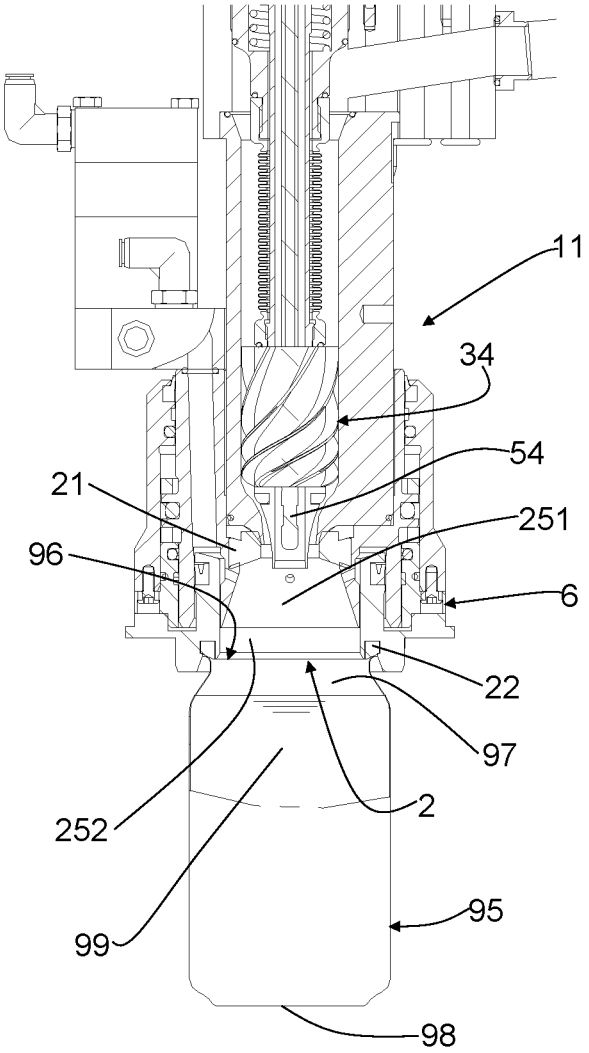

To prevent the probe 54 from remaining protruding when not necessary, the probe 54 is movable between an operating position, in which the probe 54 protrudes from the dispenser 3 and extends into the housing 2 (as shown for example in FIGS. 7 and 8), and a non-operating position, in which the probe 54 is retracted inside the dispenser 3 (as shown for example in FIGS. 9 and 10).

Therefore, the probe 54 is in the operating position when the filling unit 1 is used for filling a container 90 of the first type, whilst it is in the non-operating position when the filling unit 1 is used for filling a container 95 of the second type. That is useful for preventing the probe 54 from being able to interfere with filling of the containers 95 and/or with their movement.

In the embodiment shown, the probe 54 is mounted on a rod 55 (at a lower end of the latter) which extends axially along said longitudinal axis 40 and is constrained to a retaining element 56 mounted at the top of the main body 11. The retaining element 56 is fixable to the main body 11 in a plurality of axially spaced seats. The second position, in which the probe 54 is not operative, may correspond to the retaining element 56 mounted in the highest seat. The top part of the main body 11, where the retaining element 56 is mounted, is easily accessible (in particular, it has an open frame) to allow adjustment of the position of the rod 55 relative to the retaining element 56 and therefore of the length of the section protruding into the housing 2.

Moreover there may be a pneumatic actuator 58 for automatically adjusting the position of the rod 55 of the probe 54 and the length of its protruding section. For example the pneumatic actuator 58 has air inlets 581 connected to a solenoid valve remotely located in the pneumatic panel.

In one possible mode of use, the retaining element 56 is used to keep the rod 55 in the non-operating position for filling containers 95 of the second type. The pneumatic actuator 58 is used for adjusting the position of the rod 55 in the operating position for filling containers 90 of the first type.

If necessary, the rod 55 may be telescopic and therefore the probe 54 may assume the non-operating position and the operating position with different lengths of the protruding section without moving the retaining element 56 (this is the embodiment shown in the figures). For example, the pneumatic actuator 58 acts on one of the telescopic sections.

The level sensor 51 also comprises a transducer 57 which reads the signal of the probe 54 and is connected to the control system for transmitting the reading taken. In particular, the level sensor 51 is of the conductive type.

In the example embodiment, the stem 44 of the valve 4 has an axial cavity 440 and the rod 55 of the level sensor 51 is slidably housed in the axial cavity 440. As shown in FIGS. 9 and 10, in the non-operating position the probe 54 is retracted inside the axial cavity 440 of the stem 44, without protruding from the dispensing opening 30.

A second innovative aspect of the filling unit 1 described here relates to the movement of the parts of the filling unit 1 for positioning the container 90, 95 in the position required for filling.

The lateral wall 25 of the housing 2 is formed at least partly by an annular body 6 that is movable relative to the bottom wall 24 of the housing 2. The second annular gasket 22 is mounted on the annular body 6. Basically, the annular body 6 is a sealing and centring bell for the containers 95 of the second type.

The annular body 6 moves towards or, vice versa, away from the plate 12 (in particular it is a movement along a vertical line), therefore that movement corresponds to a movement of the second annular gasket 22 away from or, vice versa, towards the bottom wall 24 of the housing 2. In any case the movement of the annular body 6 is very limited, at roughly several millimetres (for example, 8 mm or even less).

In the position away from the bottom wall 24, the cavity 26 and the lateral wall 25 have a greater height than in the position close to the bottom wall 24. The fact that the second annular gasket 22 is mounted on that movable annular body 6 is useful for taking into account the specific features of the type of container, during the step immediately before filling.

Figure 13:
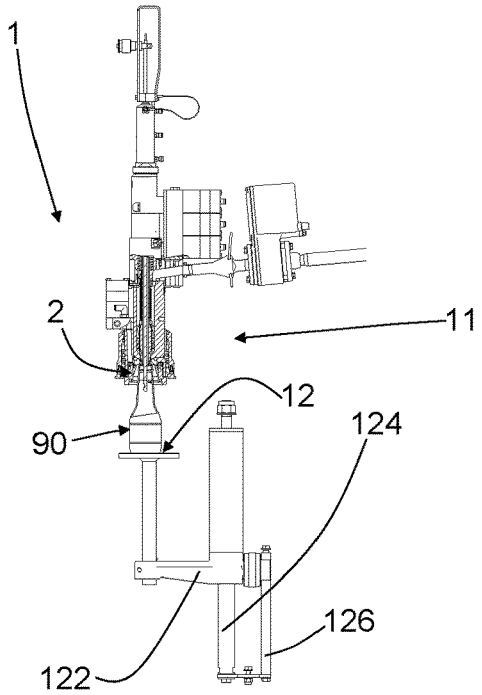
Figure 14:
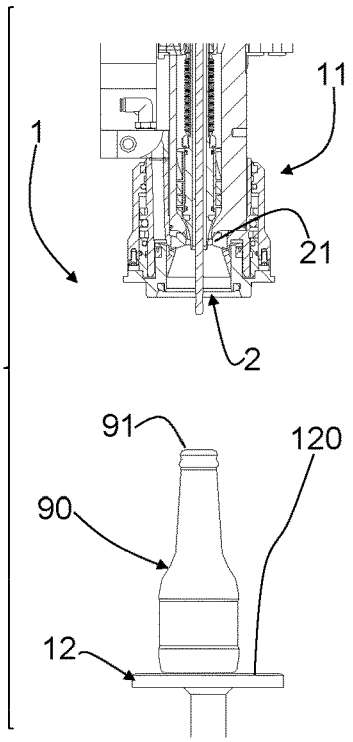
FIGS. 14 and 15 show enlarged details of FIGS. 12 and 13, respectively.
Figure 15:
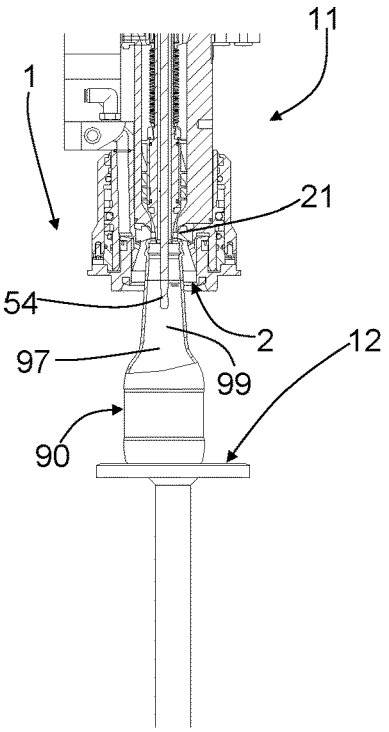
Figure 16:
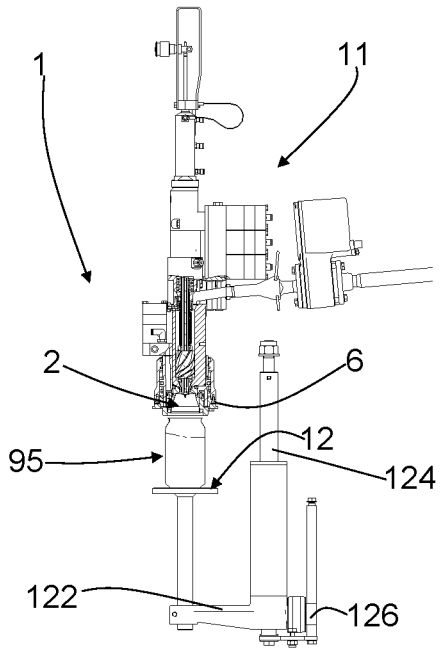
FIGS. 16 and 17 are cross-sectional side views of an initial positioning step and a final filling step for a container of the second type in the filling unit of FIG. 1.
Figure 17:
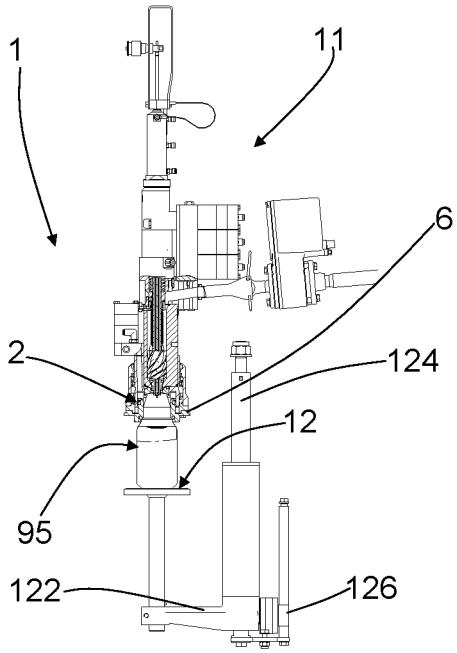
Figure 18:
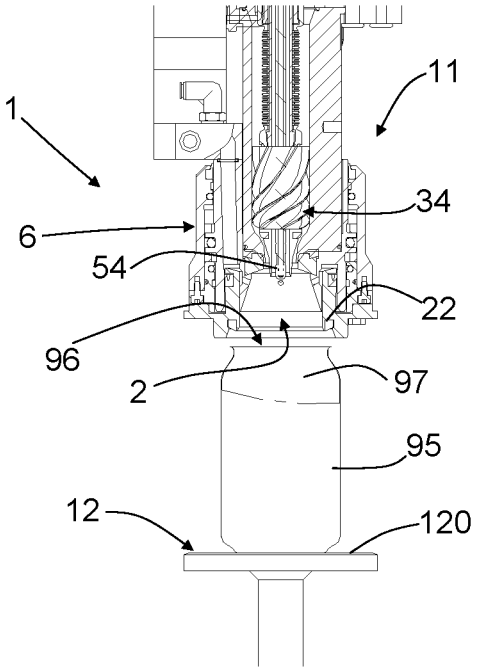
FIGS. 18 and 19 shows enlarged details of FIGS. 16 and 17, respectively.
Figure 19:
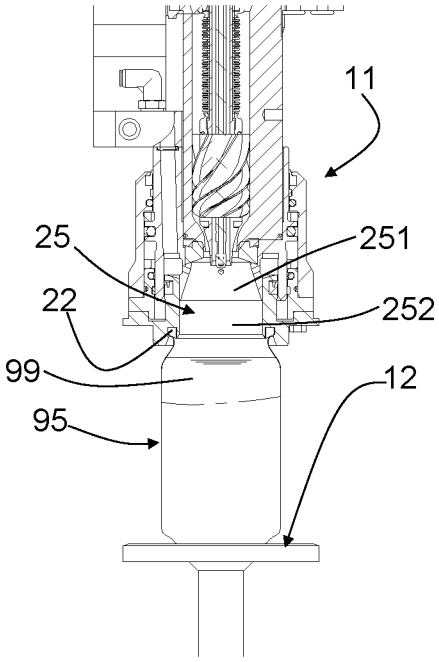
Figure 23:
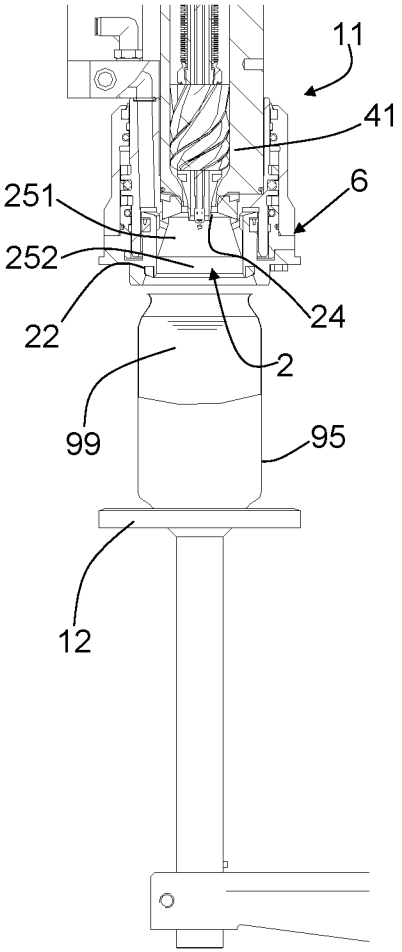
FIGS. 20 to 23 are cross-sectional side views of four steps of the procedure for filling a container of the second type in the filling unit of FIG. 1.
Figure 22:
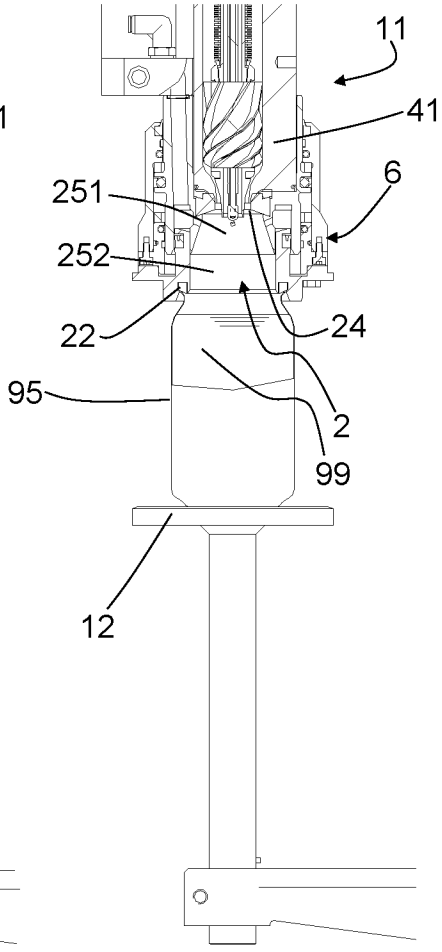

That is shown in FIGS. 12 to 15 for a container 90 of the first type. After the container 90 has been positioned on the plate 12 (FIGS. 12 and 14), the plate 12 is moved towards the dispenser 3 to bring the mouth 91 of the container 90 into contact with the first annular gasket 21 and filling can take place (FIGS. 13 and 15). Basically, the mouth 91 is initially quite far from the housing 2 in the main body 11 of the filling unit 1. Operation of the first actuator 126 lifts the container 90 towards the main body 11, the mouth 91 enters the housing 2 until it abuts against the first annular gasket 21 (which in particular is positioned on the bottom wall 24, but if necessary it could be positioned on the lateral wall 25). The container 90 is positioned and ready to be filled. At the end of the filling, the plate 12 is lowered by the first actuator 126 and the filled container 90 can be removed.

Figure 21:
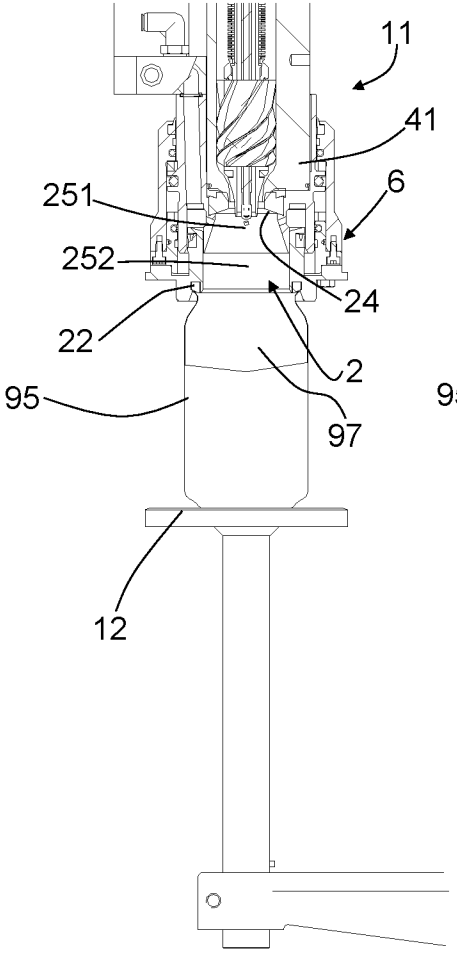
Figure 20:
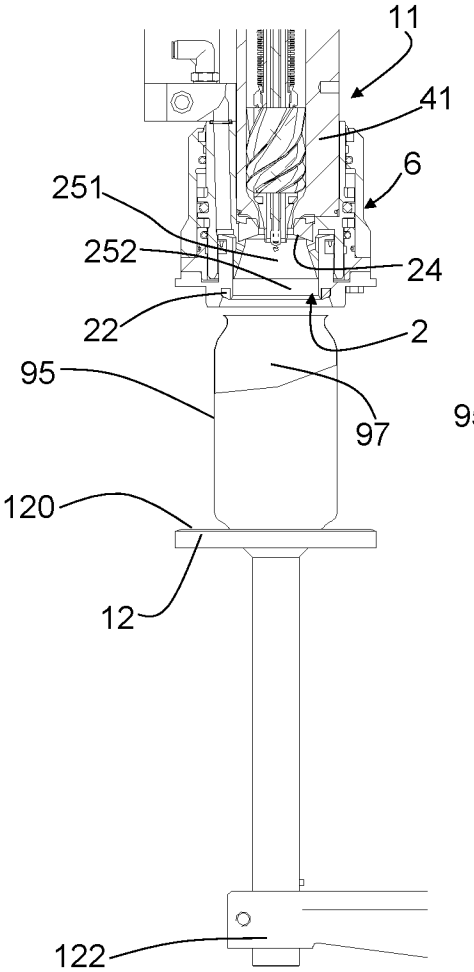

For a container 95 of the second type, reference should be made to FIGS. 16 to 23. After the container 95 has been positioned on the plate 12 (FIGS. 16, 18 and 20), the annular body 6 is moved towards the plate 12 to bring the second annular gasket 22 into contact with the mouth 96 of the container 95 (FIG. 21). The container 95 is filled (FIGS. 17, 19 and 22), and at the end of the filling the annular body 6 is moved away from the plate 12 (FIG. 23) and the filled container 95 can be removed.

Basically: for the first type of containers the seal with the gasket is obtained by pushing the container (by means of the plate 12) against the gasket 21; for the second type of containers the seal with the gasket is obtained by pushing the gasket 22 (by means of the annular body 6) against the container.

This way of operating is useful for the following reasons.

The container 90 of the first type has a mouth 91 with a smaller diameter than the containers 95 of the second type and consequently the respective gasket 21 is smaller and nearer the bottom wall 24.

Therefore, greater insertion into the housing 2 and greater relative movement between the container 90 and the respective gasket 21 are required. That is achieved in a practical way by moving the plate 12 upwards, indeed the plate 12 is a structure which is simple and light to move and its travel may be selected with the necessary value, without particular structural constraints. Moreover, it should be considered that, for containers 90 which are for example glass bottles, the container has a certain weight and a structural strength. Therefore, the container 90 remains stable on the plate 12 during the upward movement and, during the pressing against the gasket 21, there is a greater tolerance on the upward pushing force without damaging the container.

The container 95 of the second type has a mouth 96 with a larger diameter, therefore it requires less insertion into the housing 2 and less relative movement between the container 95 and the respective gasket 22. That is easily achieved thanks to the annular body 6, which thereby allows the above to be achieved by minimising the masses in movement, whilst the plate 12 is not moved. For containers 95 which are for example aluminium cans, the container is light and its wall is thin and deformable. Therefore, keeping the plate 12 stationary avoids the risk that the container 95 might move and lose its centring. Moreover the movement of the annular body 6 is small and the force which the annular body 6 applies on the mouth 96 of the container is more easily controllable than what is achievable by moving the plate 12, therefore it is easier to keep it within a value which does not damage the container 95 when the latter makes contact with the gasket 22.

For moving the annular body 6, the main body 11 comprises a second actuator 62. Specifically, the second actuator 62 is a pneumatic actuator which is fitted with two air inlets 621, 622 for controlling respectively the movement towards and the movement away from the plate 12. The second actuator 62 is controlled by solenoid valves remotely located in the pneumatic panel of the control system.

The control system is configured to move the first actuator 126 of the plate 12 and the second actuator 62 of the annular body 6 based on the type of container to be filled.

Figure 1:
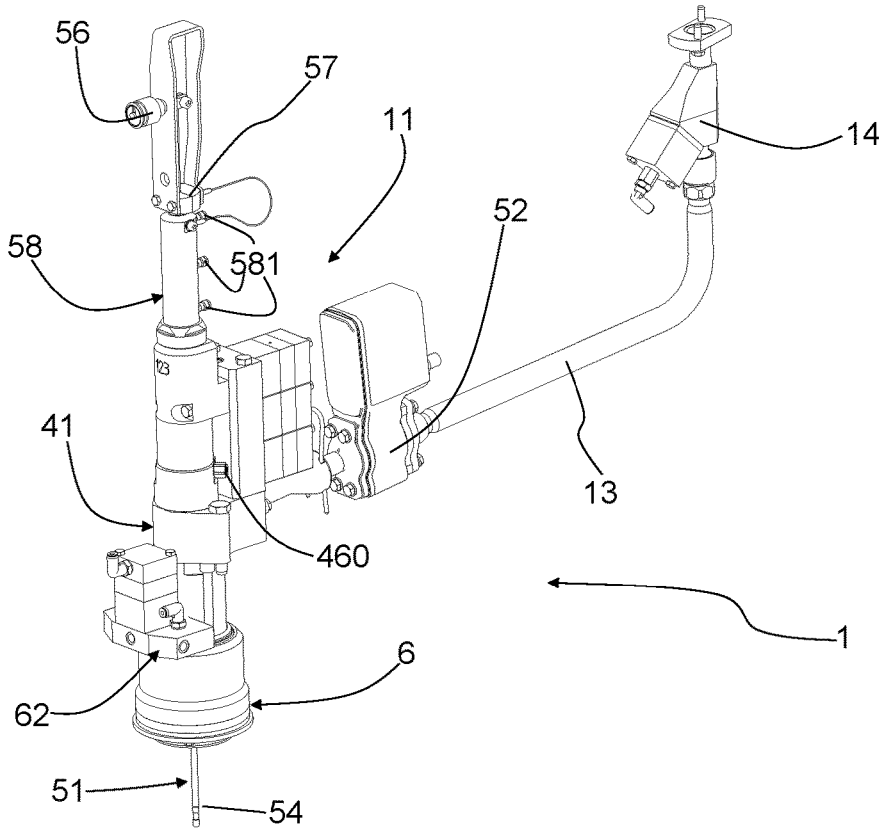
FIG. 1 is a perspective view of a filling unit according to this invention.
Figure 2:
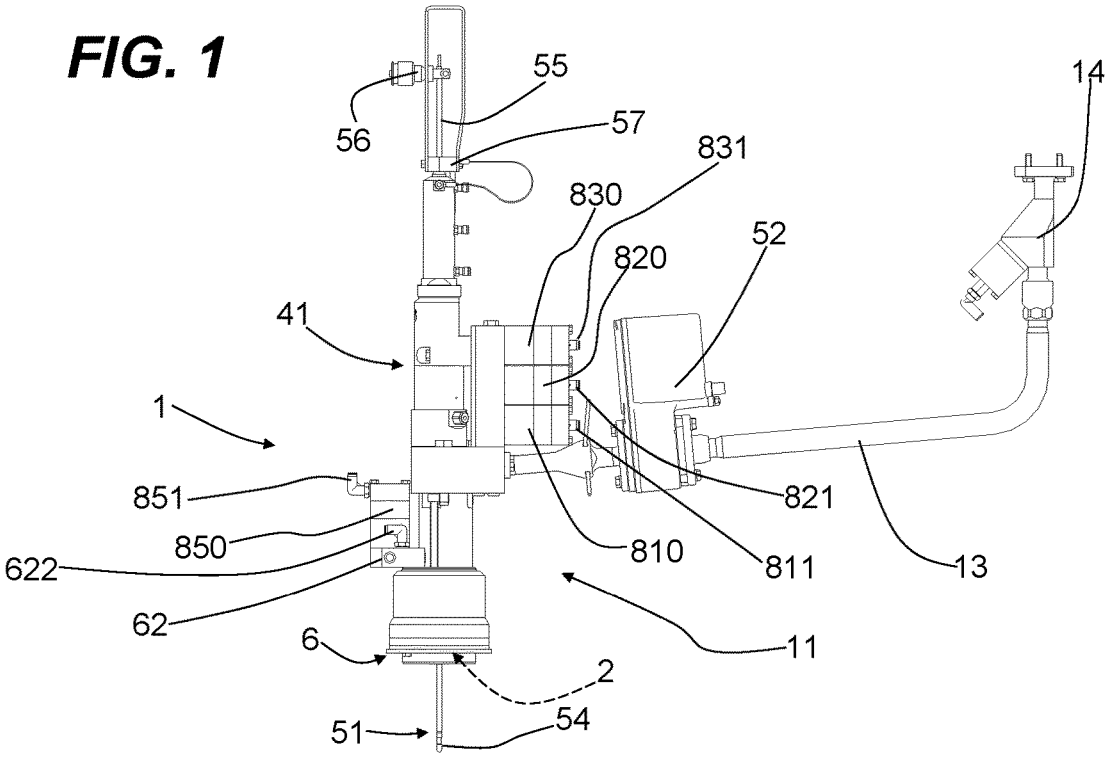
FIG. 2 is a side view of the filling unit of FIG. 1.
Figure 3:
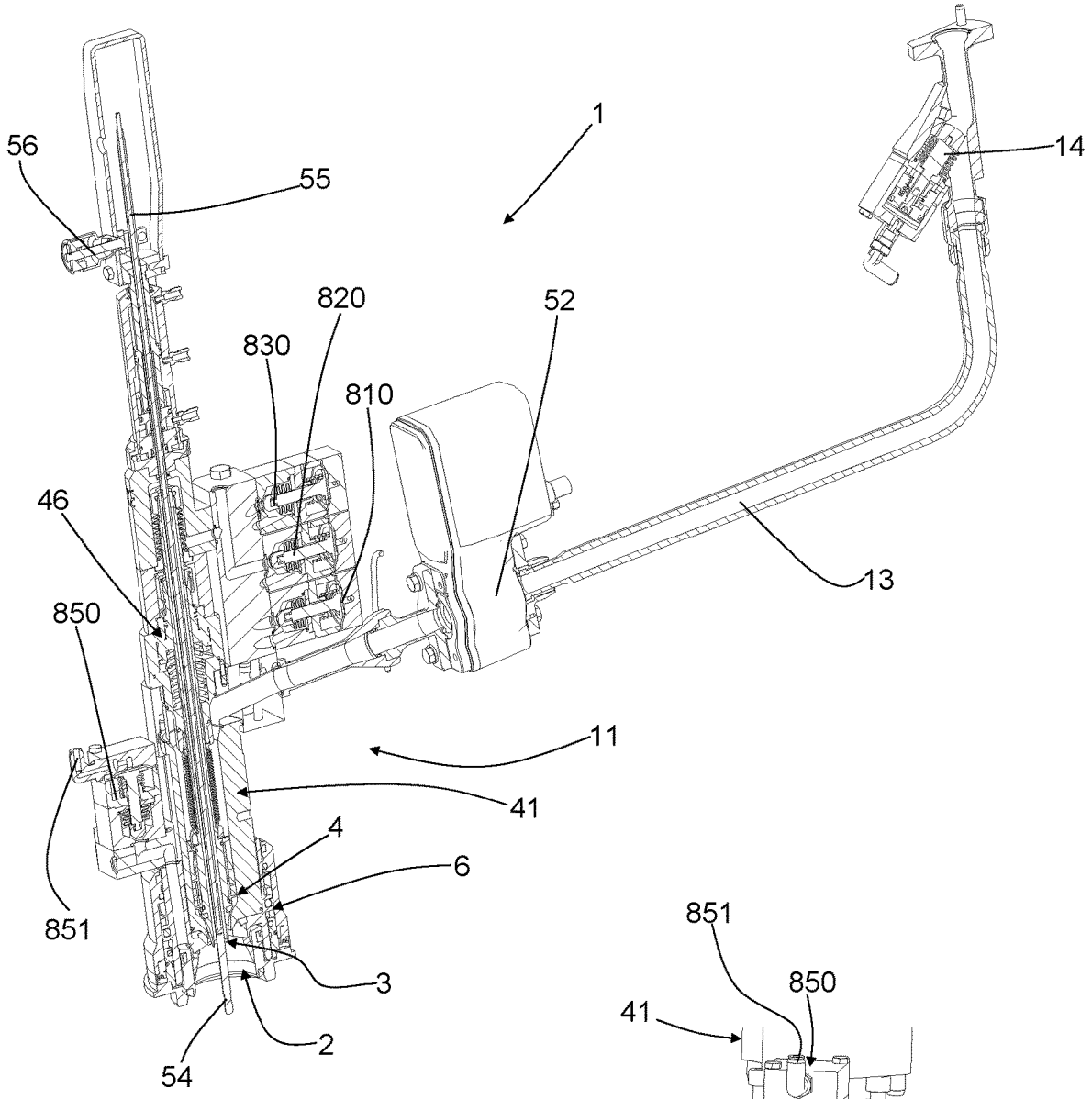
FIG. 3 is a perspective view in cross-section of the filling unit of FIG. 1.
Figure 4:
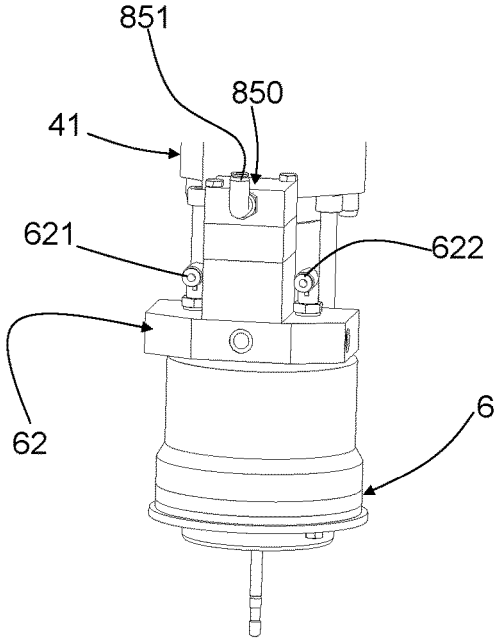
FIG. 4 is a perspective view of a detail of the filling unit of FIG. 1.
Figure 5:
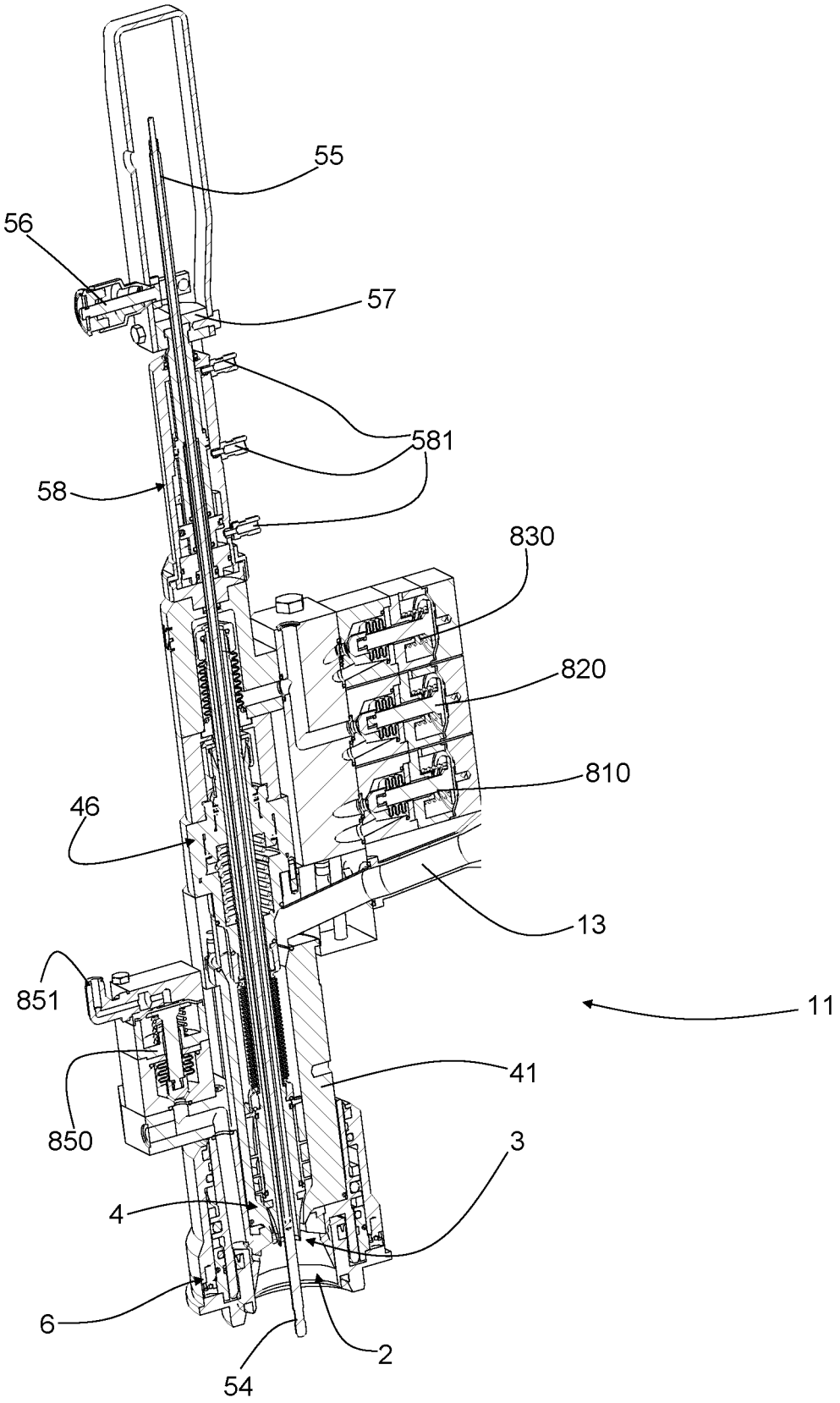
FIG. 5 shows an enlarged detail of the cross-section view of FIG. 3.
Figure 6:
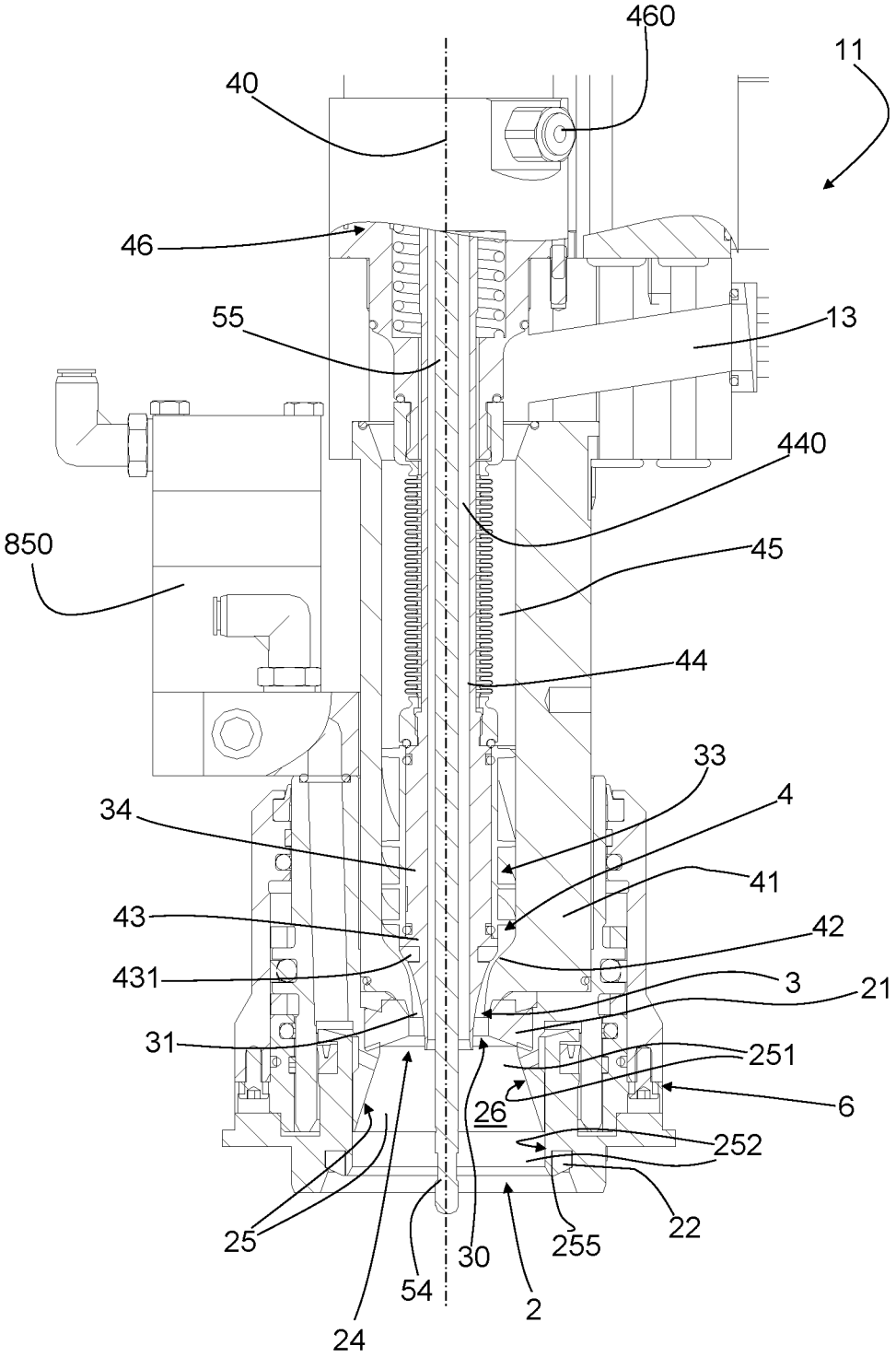
FIG. 6 is a side view in cross-section, of an enlarged detail of the filling unit of FIG. 1.

The first section 251 of the lateral wall 25 diverges from the bottom wall 24 towards the plate 12, specifically the first section has a truncated cone shape; in contrast, the annular body 6 forms a second section 252 of the lateral wall 25 and that second section 252 is cylindrical. The first section 251 is interposed between the bottom wall 24 and the second section 252; the two sections 251, 252 are joined to each other, in such a way that at their interface they substantially have the same diameter (within machining tolerance limits). The annular body 6 forms an outer edge 255 of the second section 252 of the lateral wall 25 and the second annular gasket 22 circumscribes said outer edge 255. Basically, as shown for example in FIG. 6, the second annular gasket 22 is external relative to the cylindrical section 252 of the lateral wall 25 and is housed in a respective seat which is around the outer edge 255.

In the embodiment illustrated, the annular body 6 is positioned outside the valve body 41 and is slidably mounted on the outer surface of the valve body 41, with which it is coaxial. In other words, the annular body 6 is coaxial with the longitudinal axis 40 of the stem 44 and is slidable along said longitudinal axis 40 in order to perform the movement described above.

A third innovative aspect of the filling unit 1 described here relates to the creation of a particular flow of liquid substance in the container during the filling.

The dispenser 3 has a cross-section reducing element 33 that is substantially coaxial with the dispensing duct 31 and occupies its central region, extending as far as the dispensing opening 30. The dispensing duct 31 and the dispensing opening 30 have an annular-shaped passage cross-section (annulus-like), whose outer face is the wall of the dispensing duct 31 and whose inner face is the surface of the cross-section reducing element 33.

The cross-section reducing element 33 has a section 34 that is a flow modifier: that section 34 is configured to impart a rotational motion on the liquid substance 99 passing through the dispensing duct 31, so that the liquid substance comes out of the dispensing opening 30 with a helical flow. Basically, the flow-modifying section 34 creates a vortex in the liquid substance, so that the latter has a rotational movement about the axis 40 of the duct 31, in addition to the axial movement along the dispensing duct 31.

When filling a container 90 of the first type, the liquid substance 99 coming out of the dispensing opening 30 is dispensed directly into the mouth 91 of the container and flows onto an internal surface of a lateral wall (ending with the mouth 91) of the container. Indeed, the first annular gasket 21 encircles the dispensing opening 30 and therefore the liquid substance directly enters the container 90; moreover the liquid substance with a helical motion expands with a centrifugal motion when, coming out of the dispensing opening 30, it is no longer contained by the wall of the duct 31 and thereby collides against the internal surface of the lateral wall of the container.

Figure 24:
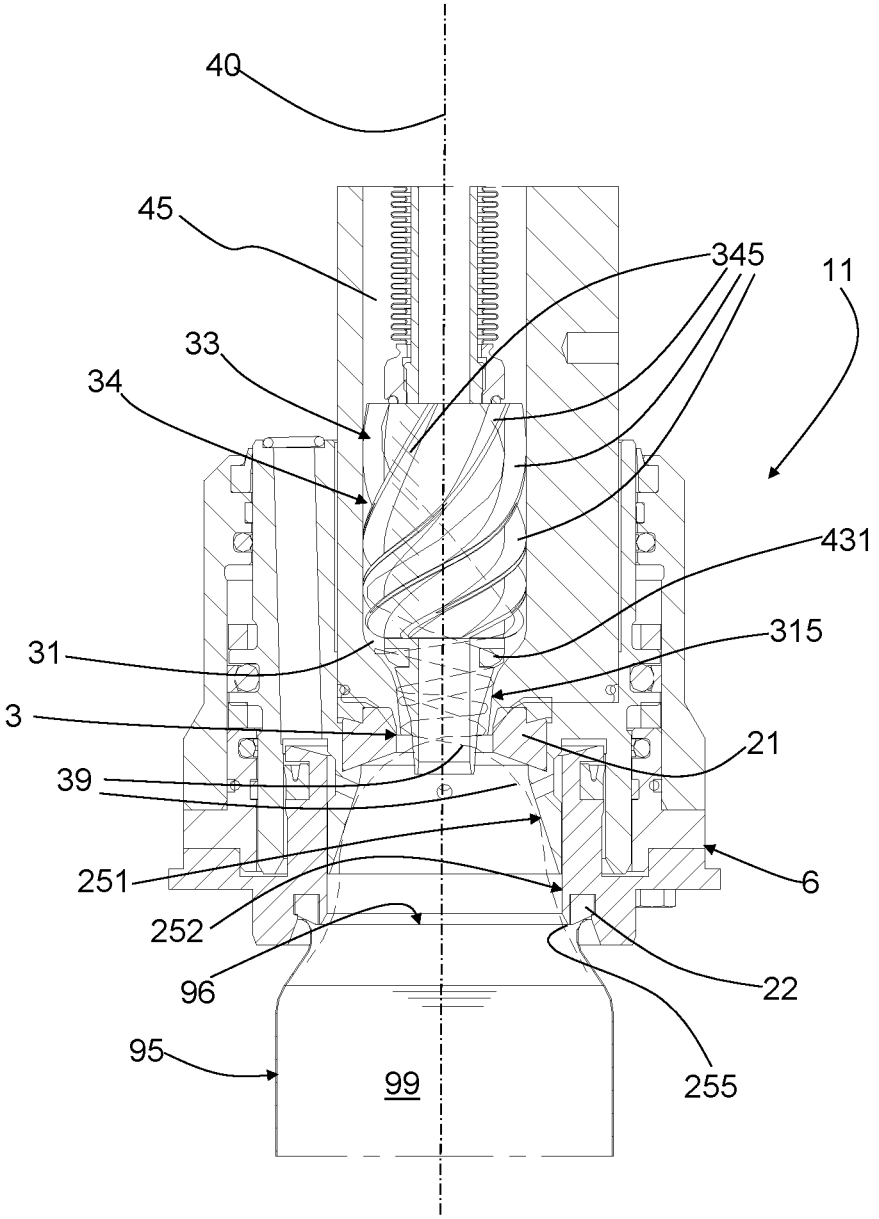
FIG. 24 is an enlarged view, partly in cross-section, of a step for filling a container of the second type, in which the path of the liquid substance is also shown.

In contrast, when filling a container 95 of the second type, the liquid substance 99 coming out of the dispensing opening 30 flows onto the lateral wall 25 of the housing 2 and, after having entered the mouth 96 of the container 95, flows onto an internal surface of a lateral wall (ending with the mouth 96) of the container. Indeed the second annular gasket 22 and therefore the mouth 96 are apart from the bottom wall 24 on which the dispensing opening 30 is located. Therefore, the liquid substance with a helical motion coming out of the dispensing opening 30 expands with a centrifugal motion, but encounters the lateral wall 25 of the housing 2. Descending along the lateral wall 25, it enters the container 95. Thanks to the sizing of the lateral wall 25 in its lower part, the liquid substance entering the container 95 goes onto the internal surface of the lateral wall of the latter, instead of falling in a central region of the container 95. The path of the liquid substance is shown in FIG. 24, where it is indicated with broken lines having the reference number 39.

All of that is useful in particular when the liquid substance is a carbonated beverage, because the flow of the liquid substance on the internal surface of the container is of the laminar type, therefore preventing a vigorous mixing of the substance already in the container and that which is entering the container. In the case of a carbonated beverage, that vigorous mixing has the disadvantage that it would produce froth in the container.

Basically, the bell shape of the housing 2 replicates, for a container of the second type, the effect which, for a container of the first type, is produced directly by the internal surface of the container, that is to say, offering a surface which receives the liquid substance dispensed and guides the latter into the internal volume of the container with a laminar flow.

Consequently the third aspect described above allows the filling unit 1 to be used for filling in an equally effective way both containers of the first type and containers of the second type, without any need to substitute parts of the filling head 11 to adapt it to one type or the other.

A passage of the liquid substance from the lateral wall 25 to the internal surface of the container 95 of the second type is favoured in particular by the fact that the lateral wall 25 comprises an annular edge 255 and that the second annular gasket 22 circumscribes the annular edge 255. During the filling, the annular edge 255 is near the internal surface of the container 95 and therefore the liquid substance which flows on the lateral wall 25 goes beyond the annular edge 255 and passes directly onto the internal surface.

In particular, that annular edge is the outer edge 255 of the second section 252 of the lateral wall 25.

The flow-modifying section 34 is fitted with ribs 345 or vanes on its surface. Those ribs 345 or vanes are capable of diverting the flow of liquid substance and imparting a rotational component on the flow. In particular, as shown in FIG. 24, the height of the ribs 345 is equal to the width of the passage cross-section in the dispensing duct 31, that it so say, they are substantially in contact with the wall of the dispensing duct 31.

The ribs 345 have a helical shape with variable pitch, the pitch decreasing in the direction of flow.

The dispensing duct 31 comprises a convergent-shaped section 315, that is positioned between the flow-modifying section 34 and the dispensing opening 30. That convergent section 315, by reducing the radius of the duct, increases the centrifugal effect for the liquid substance coming out of the dispensing opening 30.

In the embodiment illustrated, the cross-section reducing element 33 (which comprises the flow-modifying section 34) is part of the stem 44 and/or the valve member 43 of the valve 4, which is located in the dispensing duct 31. The flow-modifying section 34 is located upstream of the seal seat 42, that is to say, the seal seat 42 is interposed between the flow-modifying section 34 and the dispensing opening 30.

In a more general embodiment, the cross-section reducing element 33 is joint to the stem and/or the valve member, without being part of it and if necessary without the valve 4 being located in the dispensing duct 31 (for example, the valve could be upstream of the flow-modifying section).

The machine 100 comprises a plurality of filling units 1 (for example, it comprises forty of said units), a device for supplying containers to be filled to the filling units 1, a device for removing filled containers from the filling units 1, a system for feeding the liquid substance into the feed ducts 13 of the filling units 1.

In particular, as shown in FIGS. 25 and 26 and similarly to prior art machines, the machine 100 comprises a carousel structure 110 on which the filling units 1 are mounted. The carousel structure 110 is rotatable about a vertical axis 115 relative to a base 105 and comprises a lower part 111, on which the fixed structures 124 of the plates 12 and therefore the plates 12 themselves are mounted, and an upper part 112, on which the main bodies 11 and the feed ducts 13 of the filling units 1 are mounted.

The upper part 112 rotates jointly with the lower part 111 about the axis 115 and is movable relative to the lower part 111 by a translation along the axis 115.

As shown by a comparison between FIGS. 25 and 26, for the containers 90 of the first type (bottles) the upper part 112 is further from the lower part 111, so as to leave travel space for the movement of the plates 12; for the containers 95 of the second type (cans), the upper part 112 is nearer the lower part 111, since the travel of the annular bodies 6 of the filling units 1 is much shorter than the travel of the plates 12.

Moreover the bottles usually have a greater height than the cans and therefore that requires a greater distance between the plate 12 and the housing 2 during the filling.

When the machine 100 is used in a first operating mode, that is to say, to fill containers 90 of the first type, the upper part 112 is translated away from the lower part 111 and therefore the main bodies 11 of the filling units 1 are moved away from the respective plates 12 mounted on the lower part 111; when the machine 100 is used in a second operating mode, that is to say, to fill containers 95 of the second type, the upper part 112 is translated towards the lower part 111 and therefore the main bodies 11 of the filling units 1 are moved towards the respective plates 12.

As regards the device for supplying containers, the device for removing containers and the details of the filling method, these can be made and implemented in a known way and therefore they are not described in further detail. One example of a device 120 for removing containers is shown in FIGS. 25 and 26. However, since it is the subject-matter of a separate patent application, its aspects are not described here.

Thanks to the filling units 1 according to this invention, the use of the machine 100 in the first operating mode (for example to fill bottles), the use of the machine 100 in the second operating mode (for example to fill cans) and the switch from one operating mode to the other operating mode depending on production requirements are very easy and effective.

The invention described above may be modified and adapted in several ways without thereby departing from the scope of the inventive concept set out in the attached claims.

All details may be substituted with other technically equivalent elements and the materials used, as well as the shapes and dimensions of the various components, may vary according to requirements.

The invention claimed is:

1. A filling unit (1) for filling containers with a liquid substance (99), comprising:

a plate (12) forming a resting surface for the base in a container to be filled;

a housing (2) configured to receive a mouth of the container to be filled, the housing (2) facing the plate (12) and forming a cavity (26) which opens towards the plate (12);

a dispenser (3) which opens onto the housing (2) and faces the plate (12), the dispenser (3)—in use—facing the mouth of the container so as to dispense, through a dispensing opening (30), the liquid substance (99) towards an internal volume of the container;

a feed duct (13) for feeding the liquid substance (99) to the dispenser (2);

a valve (4) interposed between the feed duct (13) and the dispensing opening (30), the valve (4) being controllable to assume an open position and a closed position, thus allowing and preventing the liquid substance (99) to be dispensed from the dispenser (3);

the filling unit (1) being configured to fill containers (90) of a first type and to fill containers (95) of a second type, the housing (2) being configured to receive the mouth (91) of a container (90) of the first type and, alternatively, the mouth (96) of a container (95) of a second type, wherein the plate (12) is movable towards or, vice versa, away from the dispenser (3), wherein the housing (2) comprises a bottom wall (24), on which the dispenser (3) opens, and a lateral wall (25), the cavity (26) of the housing (2) being delimited by the bottom wall (24) and the lateral wall (25), the housing (2) being fitted with a first annular gasket (21), designed to come into contact with the mouth (91) of a container (90) of the first type, and a second annular gasket (22), designed to come into contact with the mouth (96) of a container (95) of the second type, wherein the first annular gasket (21) is smaller in size than the second annular gasket (22) and is positioned at a shorter distance from the bottom wall (24) of the housing (2), the lateral wall (25) of the housing (2) being formed at least partly by an annular body (6) that is movable relative to the bottom wall (24), moving towards or, vice versa, away from the plate (12), the second annular gasket (22) being mounted on said annular body (6), the filling unit (1) being configured to operate in such a way that:

after a container (90) of the first type has been positioned on the plate (12), the plate (12) is moved towards the dispenser (3) to bring the mouth (91) of the container (90) into contact with the first annular gasket (21); and after a container (95) of the second type has been positioned on the plate (12), the annular body (6) of the housing (2) is moved towards the plate (12) to bring the second annular gasket (22) into contact with the mouth (96) of the container (95).

2. The filling unit (1) according to claim 1, wherein the first annular gasket (21) is mounted on the bottom wall (24) of the housing (2).

3. The filling unit (1) according to claim 1, wherein at least a first section (251) of the lateral wall (25) of the housing (2) has a divergent shape, in particular a truncated cone shape, which diverges from the bottom wall (24) towards the second annular gasket (22).

4. The filling unit (1) according to claim 3, wherein the annular body (6) forms a cylindrical section (252) of the lateral wall (25) of the housing (2), wherein the first section (251) having the divergent shape is interposed between the bottom wall (24) and a second section that is the cylindrical section (252) formed by the annular body (6), the second section (252) being joined to the first section (251).

5. The filling unit (1) according to claim 4, wherein the first annular gasket (21) is mounted on the bottom wall (24) of the housing (2).

6. The filling unit (1) according to claim 4, wherein the annular body (6) forms an outer edge (255) of the cylindrical section (252) of the lateral wall (25) of the housing (2) and wherein the second annular gasket (22) circumscribes said outer edge (255).

7. The filling unit (1) according to claim 1, wherein the annular body (6) forms a cylindrical section (252) of the lateral wall (25) of the housing (2).

8. The filling unit (1) according to claim 7, wherein the annular body (6) forms an outer edge (255) of the cylindrical section (252) of the lateral wall (25) of the housing (2) and wherein the second annular gasket (22) circumscribes said outer edge (255).

9. The filling unit (1) according to claim 1, wherein the valve (4) comprises a valve body (41) and, inside the valve body (41), a seal seat (42), a valve member (43) and a stem (44) that is movable in the valve body (41), the valve member (43) being fixed to the stem (44) and being movable by the stem (44) between a position of contact with the seal seat (42), wherein the valve is closed, and a position apart from the seal seat (42), wherein the valve is open, the dispenser (3) being at one end of the valve body (41) and the stem (44) having an axial extension that is substantially coaxial with the dispensing opening (30) of the dispenser (3), the annular body (6) being coaxial with the valve body (41) and being slidably mounted on the outer surface of the valve body (41).

10. The filling unit (1) according to claim 1, comprising a first actuator (126) for moving the plate (12), a second actuator (62) for moving the annular body (6), a control system for moving the first actuator (126) and the second actuator (62) according to the type of container to be filled.

11. The filling unit (1) according to claim 1, which can be used for filling bottles and for filling cans, the containers (90) of the first type being bottles and the containers (95) of the second type being cans.

12. A machine (100) for filling containers with a liquid substance (99), comprising a plurality of filling units (1) according to claim 1, a device for supplying fillable containers to the filling units (1), a device for removing filled containers from the filling units (1), a system for feeding the feed ducts (13) of the filling units (1) with the liquid substance (99), wherein the machine (100) can be used, in a first operating mode, for filling containers (90) of the first type and, in a second operating mode, for filling containers (95) of the second type.

13. The machine (100) according to claim 12, comprising a carousel structure (110) rotatable about a vertical axis (115), wherein the carousel structure (110) comprises a lower part (111), on which the plates (12) of the filling units (1) are mounted, and an upper part (112), on which filling heads (11) of the filling units (1) are mounted, each filling head (11) comprising the housing (2), the dispenser (3) and the valve (4), wherein the upper part (112) rotates jointly with the lower part (111) about the vertical axis (115) and is movable relative to the lower part (111) by a translation along the axis (115), wherein, when the machine (100) is used in the first operating mode, the upper part (112) is translated away from the lower part (111) and, when the machine (100) is used in the second operating mode, the upper part (112) is translated towards the lower part (111).

* * * * *